US012708979B2

(12) United States Patent
Hashimoto et al.

(10) Patent No.: US 12,708,979 B2
(45) Date of Patent: Aug. 18, 2026

(54) WAVINESS PREDICTION DEVICE, WAVINESS PREDICTION METHOD, PROCESSING METHOD FOR POLISHING TARGET ARTICLE, AND PROGRAM

(71) Applicant: Resonac Corporation, Tokyo (JP)

(72) Inventors: Shuki Hashimoto, Tokyo (JP); Yusuke Togo, Tokyo (JP); Motoyuki Narisawa, Tokyo (JP); Shimpei Takemoto, Tokyo (JP); Yoshishige Okuno, Tokyo (JP)

(73) Assignee: Resonac Corporation, Tokyo (JP)

( * ) Notice: Subject to any disclaimer, the term of this patent is extended or adjusted under 35 U.S.C. 154(b) by 287 days.

(21) Appl. No.: 18/724,022

(22) PCT Filed: Dec. 20, 2022

(86) PCT No.: PCT/JP2022/046888
§ 371 (c)(1),
(2) Date: Jun. 25, 2024

(87) PCT Pub. No.: WO2023/127601
PCT Pub. Date: Jul. 6, 2023

(65) Prior Publication Data

US 2025/0058425 A1 Feb. 20, 2025

(30) Foreign Application Priority Data

Dec. 27, 2021 (JP) ..... 2021-212624

(51) Int. Cl.
*B24B 37/005* (2012.01)

(52) U.S. Cl.
CPC ..... *B24B 37/005* (2013.01)

(58) Field of Classification Search
CPC ..... B24B 37/005; B24B 37/013; B24B 37/04; B24B 37/042; B24B 37/10; B24B 37/105; B24B 49/12; B24B 49/02; B24B 49/04
See application file for complete search history.

(56) References Cited

U.S. PATENT DOCUMENTS 3,813,828 A * 6/1974 Bennett ..... B24B 49/16 451/291
6,613,591 B1 * 9/2003 Bhagavat ..... B24B 37/005 438/460

(Continued)

FOREIGN PATENT DOCUMENTS

JP 2014-091190 5/2014
JP 2019-507027 3/2019

(Continued)

*Primary Examiner* — Joel D Crandall
(74) *Attorney, Agent, or Firm* — IPUSA, PLLC

(57) ABSTRACT

Occurrence of waviness abnormality is predicted. A waviness prediction device includes a data input part configured to receive an input of waviness data obtained by measuring waviness of a polishing target surface that is polished by rotating a polishing pad with a planetary gear mechanism; a feature obtainment part configured to obtain a feature including both a number of processed polishing targets in the polishing pad, and a torque of a sun gear; and a waviness prediction part configured to predict the waviness by inputting the feature obtained by the feature obtainment part to a prediction model that learns a relationship between the feature and the waviness data.

12 Claims, 13 Drawing Sheets

(56) References Cited

U.S. PATENT DOCUMENTS

| | | | |
|---|---|---|---|
| 2018/0207768 | A1 | 7/2018 | Shibuya et al. |
| 2023/0201993 | A1 | 6/2023 | Takaishi et al. |

FOREIGN PATENT DOCUMENTS

| | | | | | |
|---|---|---|---|---|---|
| WO | WO-2014002467 | A1 * | 1/2014 | ..... | B24B 37/08 |
| WO | WO-2016021094 | A1 * | 2/2016 | ..... | B24B 49/16 |
| WO | WO-2018193758 | A1 * | 10/2018 | ..... | H10P 52/00 |
| WO | 2021/250937 | | 12/2021 | | |

* cited by examiner

FIG.11

(A)

| NUMBER OF PROCESSED POLISHING TARGETS | FALSE DETECTION (3 OR MORE LOTS BEFORE) | FALSE DETECTION (1 OR 2 LOTS BEFORE) | DETEC-TION | MISS |
|---|---|---|---|---|
| ~30,000 | 40 POINTS | 60 POINTS | 100 POINTS | 0 POINTS |
| 30,000~ | 60 POINTS | 80 POINTS | 100 POINTS | 0 POINTS |

(B)

| | FEATURE | EVALUATION INDICATOR VALUE |
|---|---|---|
| MODEL A | ONLY NUMBER OF PROCESSED POLISHING TARGETS | 35 POINTS |
| MODEL B | NUMBER OF PROCESSED POLISHING TARGETS + SUN GEAR TORQUE | 53 POINTS |
| MODEL C | NUMBER OF PROCESSED POLISHING TARGETS + SUN GEAR TORQUE + DIFFERENCE IN NUMBER OF ROTATIONS | 55 POINTS |

WAVINESS PREDICTION DEVICE, WAVINESS PREDICTION METHOD, PROCESSING METHOD FOR POLISHING TARGET ARTICLE, AND PROGRAM

TECHNICAL FIELD

This invention relates to waviness prediction devices, waviness prediction methods, processing methods for polishing targets, and programs.

BACKGROUND ART

In a production process of a substrate such as a semiconductor wafer or the like, a polishing step of polishing the surface of the substrate is performed. In the polishing step, a polishing amount and a surface roughness (hereinafter also referred to as "waviness") are considered as key characteristics. If these characteristics do not meet a standard for manufacturing, such substrates are discarded as unacceptable products. Also, when waviness abnormality occurs, there is a need to replace a polishing pad of a polisher.

For example, Patent Literature 1 discloses an invention of increasing polishing quality on a wafer surface by reflecting a profile in accordance with the thickness of a scanned wafer shape, to a polishing time. Also, for example, Patent Literature 2 discloses an invention of detecting the end of a service life of a polishing pad by measuring a macroscopic wavy shape of a polishing surface of the polishing pad, by linear scanning laser beams.

CITATION LIST

Patent Literature

Patent Literature 1: PCT Japanese Translation Patent Publication No. 2019-507027

Patent Literature 2: Japanese Laid-Open Patent Publication No. 2014-91190

SUMMARY OF INVENTION

Problem to be Solved by the Invention

However, waviness abnormality cannot be detected without performing sampling inspection after polishing. Also, it takes a certain period of time to measure waviness. The production process of a substrate is a series of steps, and by the time the waviness abnormality has been detected, substrates of the same lot have already proceeded to subsequent steps. Moreover, it is hard to extract only the unacceptable products with waviness abnormality from among the substrates that have completed all of the steps. Therefore, the substrates of the same lot, including acceptable products, end up having to be discarded. Thus, delay in detection of the waviness abnormality becomes a cause for reduction in yield.

In view of the above-described technical issues, it is an object of the present disclosure to predict occurrence of waviness abnormality.

Means for Solving Problem

The present disclosure includes configurations as presented below.

[1] A waviness prediction device, including:

a data input part configured to receive an input of waviness data obtained by measuring waviness of a polishing target surface that is polished by rotating a polishing pad with a planetary gear mechanism;

a feature obtainment part configured to obtain a feature including both a number of processed polishing targets in the polishing pad, and a torque of a sun gear; and a waviness prediction part configured to predict the waviness by inputting the feature obtained by the feature obtainment part to a prediction model that learns a relationship between the feature and the waviness data.

[2] The waviness prediction device as described in the above [1], in which the polishing target surface is polished by rotating, in opposite directions, an upper surface plate provided with a first polishing pad and a lower surface plate provided with a second polishing pad, and the feature further includes a difference in number of rotations between the upper surface plate and the lower surface plate.

[3] The waviness prediction device as described in the above [2], further including:

a feature generation part configured to generate a second feature including both a second number of processed polishing targets that is larger than the number of processed polishing targets, and a second torque that is the torque of the sun gear upon processing the second number of processed polishing targets, in which the waviness prediction part is configured to predict the waviness by inputting the second feature, which is generated by the feature generation part, to the prediction model.

[4] The waviness prediction device as described in the above [3], further including:

a prediction value determination part configured to compare a prediction value of the waviness, which is predicted by the waviness prediction part, with a predetermined threshold, and a processing condition searching part configured to search for a processing condition that the prediction value of the waviness becomes lower than the threshold, when the prediction value of the waviness is equal to or higher than the threshold.

[5] The waviness prediction device as described in any one of the above [1] to [4], further including:

a model learning part configured to learn the prediction model using the waviness data received by the data input part and the feature obtained by the feature obtainment part, every time a predetermined number of the polishing target surface is polished by the polishing pad.

[6] The waviness prediction device as described in the above [5], in which the model learning part is configured to learn the prediction model for each of the polishing pads.

[7] A waviness prediction method, including:

a data input procedure of receiving an input of waviness data obtained by measuring waviness of a polishing target surface that is polished by rotating a polishing pad with a planetary gear mechanism;

a feature obtainment procedure of obtaining a feature including both a number of processed polishing targets in the polishing pad, and a torque of a sun gear; and a waviness prediction procedure of predicting the waviness by inputting the feature obtained by the feature obtainment part to a prediction model that learns a relationship between the feature and the waviness data, the data input procedure, the feature obtainment procedure, and the waviness prediction procedure being performed by a computer.

[8] A processing method for a polishing target, including:

a data input procedure of receiving an input of waviness data obtained by measuring waviness of a polishing target surface that is polished by rotating a polishing pad with a planetary gear mechanism;

a feature obtainment procedure of obtaining a feature including both a number of processed polishing targets in the polishing pad, and a torque of a sun gear;

a waviness prediction procedure of predicting the waviness by inputting the feature obtained in the feature obtainment procedure to a prediction model that learns a relationship between the feature and the waviness data;

a prediction value determination procedure of comparing a prediction value of the waviness, which is predicted in the waviness prediction procedure, with a predetermined threshold;

a processing condition searching procedure of searching for a processing condition that the prediction value of the waviness becomes lower than the threshold, when the prediction value of the waviness is equal to or higher than the threshold, the data input procedure, the feature obtainment procedure, the waviness prediction procedure, the prediction value determination procedure, and the processing condition searching procedure being executed by a computer; and a processing procedure of processing the polishing target based on the processing condition that is found in the processing condition searching procedure, the processing procedure being performed by a polisher.

[9] A program for causing a computer to execute:

a data input procedure of receiving an input of waviness data obtained by measuring waviness of a polishing target surface that is polished by rotating a polishing pad with a planetary gear mechanism;

a feature obtainment procedure of obtaining a feature including both a number of processed polishing targets in the polishing pad, and a torque of a sun gear; and a waviness prediction procedure of predicting the waviness by inputting the feature obtained in the feature obtainment procedure to a prediction model that learns a relationship between the feature and the waviness data.

Advantageous Effects of Invention

According to the present disclosure, it is possible to predict occurrence of waviness abnormality.

BRIEF DESCRIPTION OF DRAWINGS

FIG. 11 (A) of FIG. 11 is a table illustrating one example of an evaluation indicator, and (B) of FIG. 11 is a table illustrating one example of evaluation results.

DESCRIPTION OF EMBODIMENTS

Hereinafter, embodiments will be described with reference to the attached drawings. Note that, in the present specification and the drawings, constituent elements having substantially the same functional configurations are given the same symbols, and duplicate description thereof will be omitted.

Embodiments

A substrate such as a semiconductor wafer or the like is produced through a series of steps. For example, a semiconductor wafer is produced through a process including: a slicing step of cutting an ingot, serving as a raw material, into the shape of a wafer; a lapping step of making the thickness of the wafer even and flattening the wafer; an etching step of chemically removing damage occurred through mechanical processing; a polishing step of polishing the surface of the wafer into a mirror surface; a cleaning step of washing the wafer and removing foreign matter adhered to the surface thereof; and the like.

For the production process of the semiconductor wafer, the above series of steps are continuously performed per lot of a predetermined number of wafers. In the polishing step, the polishing amount of the substrate and the waviness of the polishing target surface are evaluated through sampling inspection. It takes several hours to measure the waviness. Thus, even if the waviness abnormality of a certain lot is detected, that lot has already proceeded to the subsequent steps. Also, even if the waviness abnormality is detected, it is not possible to recover that lot until all of the steps are completed.

Moreover, because the measurement of the waviness takes a certain period of time, some steps are required for extracting and discarding only the unacceptable products from the lot in which the waviness abnormality is detected. This is impractical. Therefore, when the waviness abnormality is detected, all of the substrates of that lot, including acceptable products, are to be discarded.

Thus, delay in detection of the waviness abnormality becomes a cause for reduction in yield. Conversely, if the waviness abnormality can be predicted, the yield can be increased.

The present embodiment is a polishing system that performs the polishing step in the production process of the semiconductor wafer. The polishing system in the present embodiment predicts waviness of the polishing target surface that is polished by the polisher. Also, the polishing system in the present embodiment outputs an operation to be performed in accordance with a prediction value of the waviness. Especially, when waviness abnormality is predicted and there is a processing condition causing no waviness abnormality, a notification that the current processing condition is to be changed is output.

Note that, the polishing system in the present embodiment is applicable to not only the semiconductor wafer but also various substrates to be polished during the production process thereof.

<Entire Configuration of the Polishing System>

Figure 1:
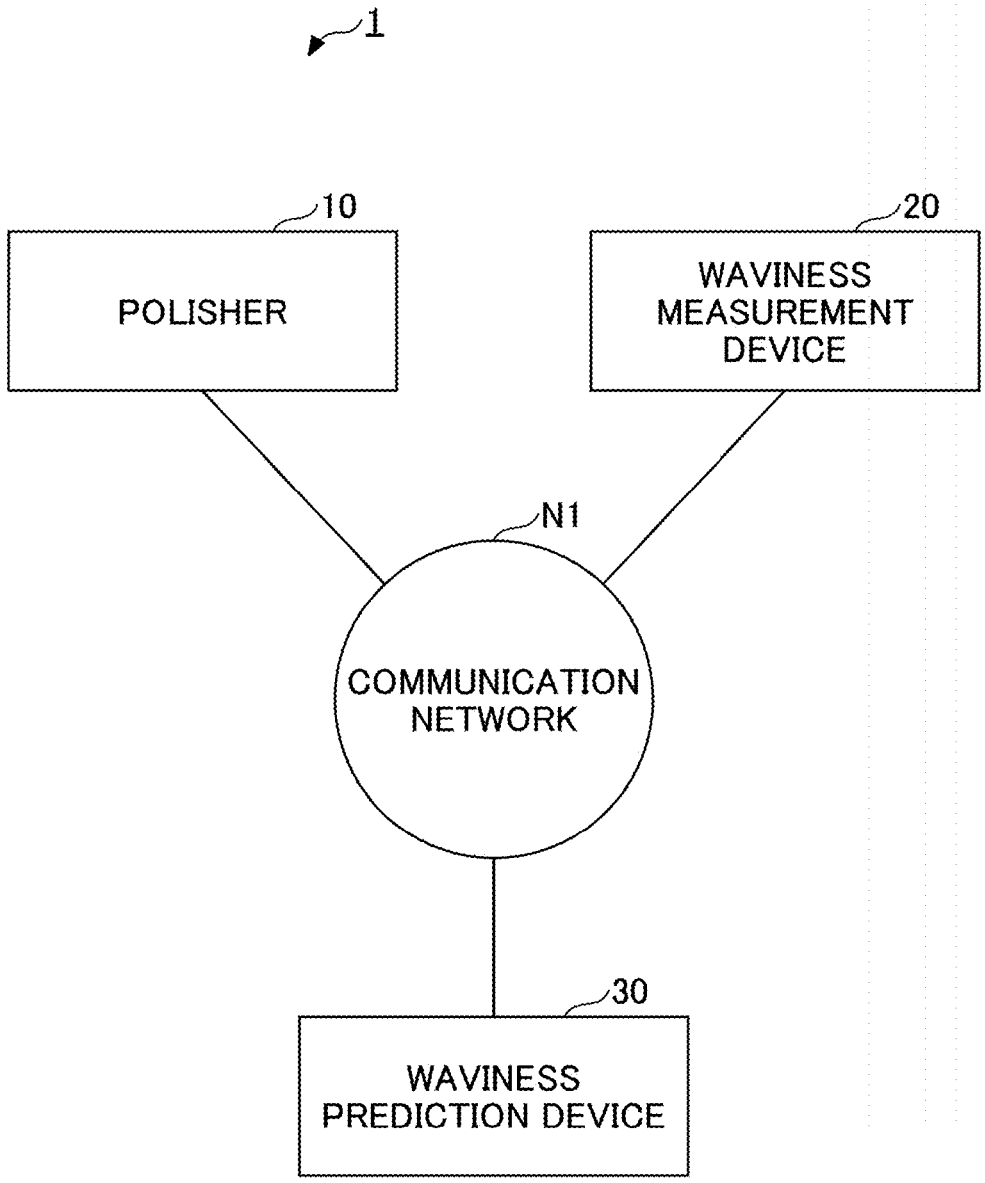
FIG. 1 is a block diagram illustrating one example of the entire configuration of a polishing system.

First, the entire configuration of the polishing system in the present embodiment will be described with reference to FIG. 1. FIG. 1 is a block diagram illustrating one example of the entire configuration of the polishing system in the present embodiment.

As illustrated in FIG. 1, a polishing system 1 in the present embodiment includes a polisher 10, a waviness measurement device 20, and a waviness prediction device 30. The polisher 10, the waviness measurement device 20, and the waviness prediction device 30 are connected to each other via a communication network N1, such as a LAN (Local Area Network), the Internet, or the like, so that data communication is possible.

The polisher 10 polishes a substrate to be polished (hereinafter also referred to as a "polishing target"). The polisher 10 in the present embodiment rotates a polishing pad with a planetary gear mechanism, thereby polishing a main surface of the polishing target (hereinafter also referred to as a "polishing target surface").

The polisher 10 polishes the polishing targets of one lot by repeating, a plurality of times, batch processing in which a predetermined number of the polishing targets are polished at the same time. For example, the polisher 10 polishes 50 substrates in one batch and performs 40 batches, thereby polishing one lot of 2,000 polishing targets.

The polisher 10 can use, for example, a double-sided polisher disclosed in Referential Document 1.

[Referential Document 1] System Seiko Co., Ltd., "Introduction of Technology", [searched on Nov. 16, 2021], Internet <URL: https://www.systemseiko.co.jp/technology/>

The waviness measurement device 20 inspects the polishing target surface polished by the polisher 10, and performs measurement of waviness. The waviness measured in the present embodiment is an indicator that is called a root mean square roughness (also called RMS: Root Mean Square, Rq). However, the indicator of the waviness applicable in the present embodiment is not limited to this, and may be any indicator.

The waviness measurement device 20 performs sampling inspection of the polishing targets after polishing, every time the polisher 10 polishes a predetermined number of the polishing targets. For example, the waviness measurement device 20 performs measurement of waviness every time the polisher 10 completes polishing of one lot.

The waviness measurement device 20 can use, for example, a surface inspection device disclosed in Referential Document 2.

[Referential Document 2] KLA Corporation, "Candela 8520", [searched on Nov. 16, 2021], Internet <URL: https://www.kla-tencor.com/products/instruments/defect-inspectors/candela-8520>

The waviness prediction device 30 is an information processor configured to predict the waviness of the polishing target surface polished by the polisher 10, such as a PC (Personal Computer), a workstation, a server, or the like. The waviness prediction device 30 learns a prediction model based on measurement values of the waviness that are output by the waviness measurement device 20 and based on processing conditions and device statuses that are obtainable from the polisher 10. Also, using the trained prediction model, the waviness prediction device 30 predicts the waviness of the polishing target surface polished by the polisher 10. Moreover, the waviness prediction device 30 outputs an operation to be performed in accordance with the prediction value of the waviness. The operation to be performed is, for example, continuation of polishing, replacement of the polishing pad, change of the processing condition, or the like.

The waviness prediction device 30 learns the prediction model every time the waviness measurement device 20 performs measurement of the waviness (i.e., the polisher 10 completes polishing of one lot). Also, the waviness prediction device 30 predicts the waviness of the polishing target surface after polishing, every time the polisher 10 polishes a predetermined number of the polishing targets. For example, the waviness prediction device 30 predicts the waviness every time the polisher 10 completes polishing of one batch.

The waviness prediction device 30 learns the prediction model per polishing pad. When the polishing pad is replaced, the waviness prediction device 30 initializes the prediction model and resumes learning. This is because it has been found that a relationship between the polishing pad and the waviness of the polishing target surface greatly differs from polishing pad to polishing pad. Therefore, the prediction model that performed learning in relation to a certain polishing pad cannot be used for prediction of the waviness of the polishing target surface polished by another polishing pad.

Note that, the entire configuration of the polishing system 1 as illustrated in FIG. 1 is one example, and can be various system configuration examples in accordance with applications and purposes. For example, the waviness prediction device 30 may be realized by a plurality of computers or may be realized as a service of cloud computing.

<Hardware Configuration of the Polishing System>

Next, a hardware configuration of the polishing system 1 in the present embodiment will be described with reference to FIG. 2 to FIG. 4.

<<Hardware Configuration of Computer>>

The waviness prediction device 30 in the present embodiment is realized by a computer or the like. FIG. 2 is a block diagram illustrating one example of the hardware configuration of a computer 500 in the present embodiment.

Figure 2:
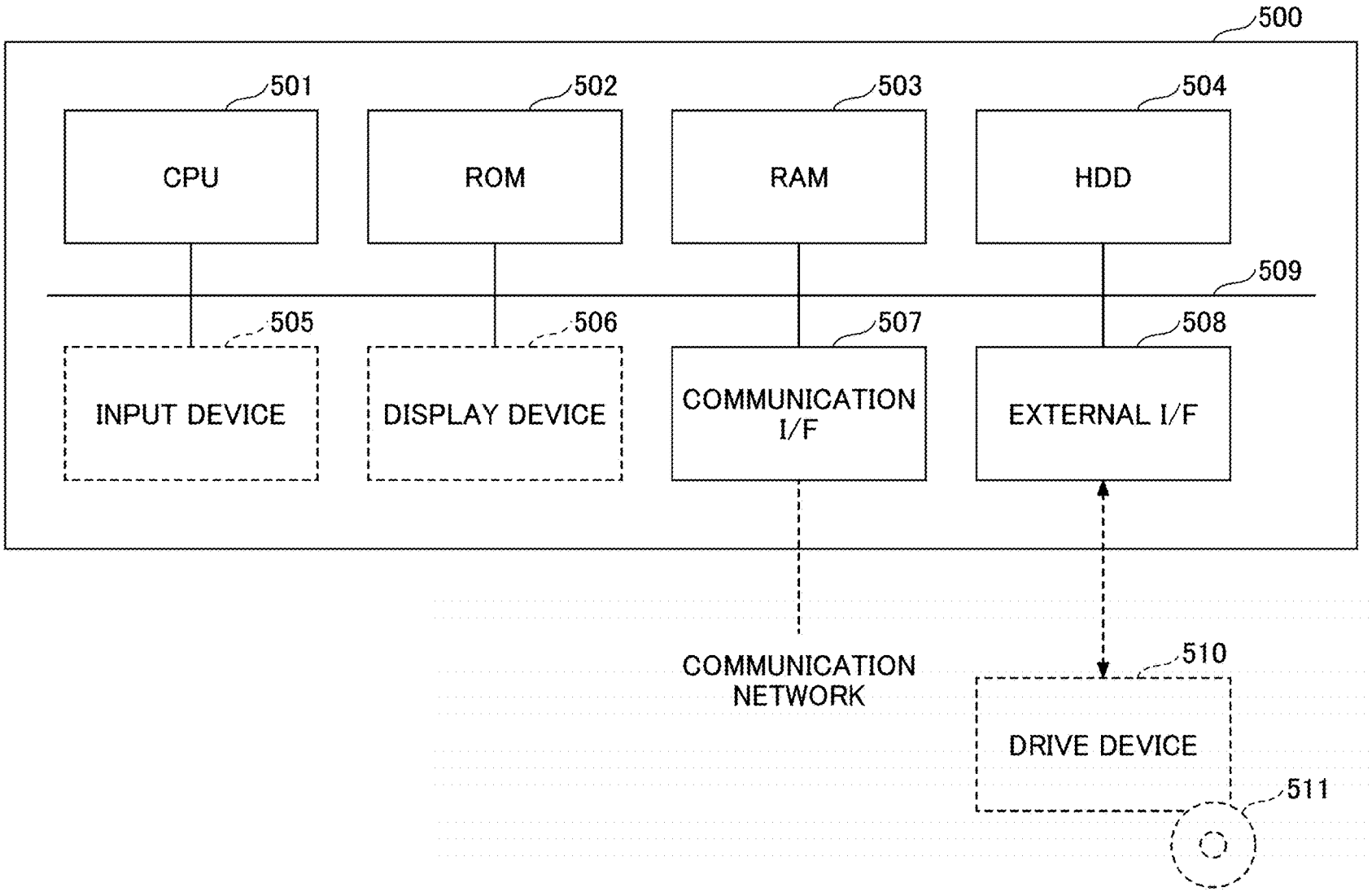
FIG. 2 is a block diagram illustrating one example of a hardware configuration of a computer.

As illustrated in FIG. 2, the computer 500 includes a CPU (Central Processing Unit) 501, a ROM (Read Only Memory) 502, a RAM (Random Access Memory) 503, a HDD (Hard Disk Drive) 504, an input device 505, a display device 506, a communication I/F (Interface) 507, and an external I/F 508. The CPU 501, the ROM 502, and the RAM 503 form what is called a computer. The hardware components of the computer 500 are connected to each other via a bus line 509. Note that, the input device 505 and the display device 506 may be in the form of being connected to the external I/F 508 in use.

The CPU 501 is an arithmetic logic unit configured to realize controls and functions of the entire computer 500 by reading out programs and data on the RAM 503 from a storage device such as the ROM 502, the HDD 504, or the like, and performing processing.

The ROM 502 is one example of a non-volatile semiconductor memory (storage device) that retains programs and data even if the power source is turned off. The ROM 502 functions as a main storage device that stores various programs, data, and the like necessary for the CPU 501 to perform various programs installed in the HDD 504.

Specifically, the ROM 502 stores a boot program performed upon start-up of the computer 500, such as BIOS (Basic Input/Output System), EFI (Extensible Firmware Interface), and the like, and data for OS (Operating System) setting, network setting, and the like.

The RAM 503 is one example of a volatile semiconductor memory (storage device) from which programs and data are deleted when the power source is turned off. The RAM 503 is a DRAM (Dynamic Random Access Memory), a SRAM (Static Random Access Memory), or the like. The RAM 503 provides a work area into which various programs installed in the HDD 504 are deployed by the CPU 501.

The HDD 504 is one example of a non-volatile storage device that stores programs and data. The programs and data stored in the HDD 504 are: OS that is basic software controlling the entire computer 500; applications that provide various functions on the OS; and the like. Note that, the computer 500 may utilize, instead of the HDD 504, a storage device using a flash memory as a storage medium (e.g., SSD: Solid State Drive).

The input device 505 is what is used by a user for inputting various signals, such as a touch panel, an operation key or button, a keyboard or mouse, a microphone in which audio data, such as voice and sound, is input.

The display device 506 is formed of: a display configured to display an image, such as a liquid crystal display, an organic EL (Electro-Luminescence) display, or the like; and a speaker configured to output audio data, such as voice and sound; and the like.

A communication I/F 507 is an interface that is connected to a communication network and in which the computer 500 performs data communication.

The external I/F 508 is an interface with an external device. The external device is a drive device 510 or the like.

The drive device 510 is a device in which a recording medium 511 is set. As used herein, the recording medium 511 includes CD-ROMs, flexible disks, and media configured to optically, electrically, or magnetically record information, such as magneto-optical disks and the like. Also, the recording medium 511 may include semiconductor memories configured to electrically record information, such as ROMs, flash memories, and the like. Thereby, the computer 500 can read from and write to the recording medium 511 via the external I/F 508.

Note that, for example, various programs to be installed in the HDD 504 are installed when the recording medium 511 delivered is set in the drive device 510 connected to the external I/F 508, and various programs stored in the recording medium 511 are read out by the drive device 510. Alternatively, various programs to be installed in the HDD 504 may be installed by being downloaded from a network different from the communication network via the communication I/F 507.

<<Hardware Configuration of Polisher>>

Figure 3:
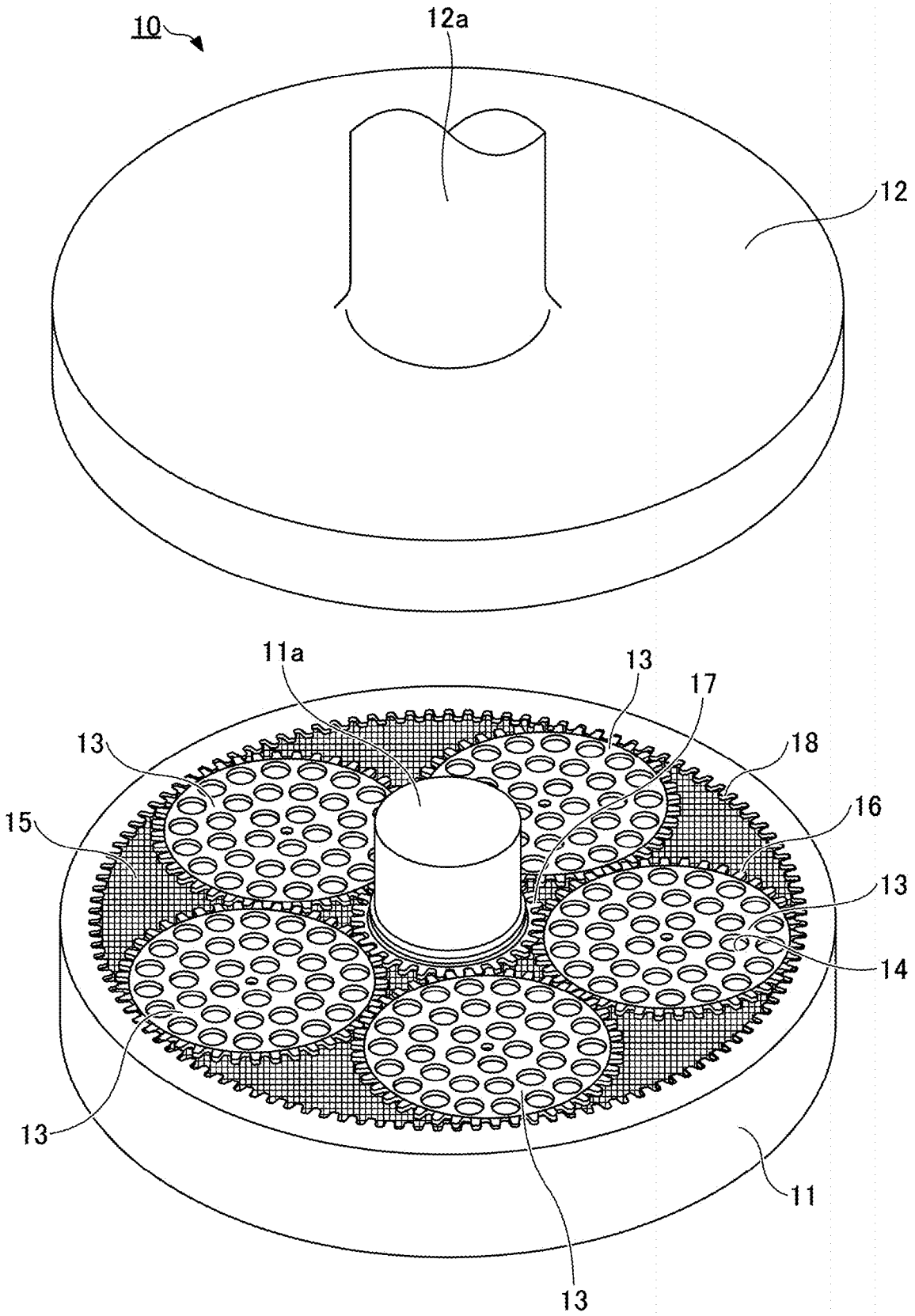
FIG. 3 is a view illustrating one example of a hardware configuration of a polisher.

FIG. 3 is a view illustrating one example of the hardware configuration of the polisher 10 in the present embodiment. As illustrated in FIG. 3, the polisher 10 in the present embodiment includes a pair of a lower surface plate 11 and an upper surface plate 12, and a plurality of carriers 13 at a surface of the lower surface plate 11 facing the upper surface plate 12. Semiconductor wafers (not illustrated) are set in a plurality of openings 14 provided in each of the carriers 13. Both of the main surfaces of a plurality of semiconductor wafers are polished by the polishing pads provided in the lower surface plate 11 and the upper surface plate 12.

Specifically, the lower surface plate 11 and the upper surface plate 12 are rotatable in opposite directions, with the center axes thereof coinciding with each other, by rotation shafts 11*a* and 12*a* provided at the respective center portions being rotated by a drive motor (not illustrated). Also, the surface of the lower surface plate 11 facing the upper surface plate 12 is provided with a recess 15 in which the plurality of carriers 13 are disposed.

The plurality of carriers 13 are formed into a disc shape from, for example, an epoxy resin that is reinforced through inclusion of aramid fibers, glass fibers, or the like. The plurality of carriers 13 are disposed shoulder to shoulder in the recess 15 about the rotation shaft 11*a*. Also, a planetary gear 16 is provided at the entire outer periphery of each of the carriers 13. Meanwhile, a sun gear 17 is provided at the inner periphery of the recess 15, and the sun gear 17 rotates together with the rotation shaft 11*a* in a state of interlocking with the planetary gear 16 of each of the carriers 13. A fixed gear 18 is provided at the outer periphery of the recess 15, and the fixed gear 18 interlocks with the planetary gear 16 of each of the carriers 13.

Thereby, when the sun gear 17 rotates together with the rotation shaft 11*a*, the plurality of carriers 13 move in what is called a planetary motion by interlocking between: the sun gear 17 and the fixed gear 18; and the planetary gear 16. In the planetary motion in the recess 15, the carriers 13 rotate about (orbit around) the rotation shaft 11*a* in the same direction as the rotation shaft 11*a*, and each of the carriers 13 rotates (spins) about the center axis thereof in the opposite direction to the rotation shaft 11*a*.

By employing the above-described configuration, therefore, it is possible to polish both of the main surfaces of the plurality of semiconductor wafers by the polishing pads provided at the lower surface plate 11 and the upper surface plate 12, while moving the plurality of semiconductor wafers retained in the openings 14 of each of the carriers 13 in the planetary motion. Also, this configuration enables more precise and rapid polishing of the semiconductor wafers.

As the polishing pad, for example, hard polishing cloth formed of urethane can be used. When both of the main surfaces of the semiconductor wafer are polished by this polishing pad, a polishing liquid is dropped onto the semiconductor wafer. The polishing liquid that is usable is, for example, a slurry obtained by dispersing abrasive grains, such as ceria, silica, diamond, or a mixture thereof, in water.

<Functional Configuration of the Polishing System>

Subsequently, a functional configuration of the polishing system in the present embodiment will be described with reference to FIG. 4. FIG. 4 is a block diagram illustrating one example of the functional configuration of the polishing system 1 in the present embodiment.

<<Functional Configuration of the Waviness Prediction Device>>

Figure 4:
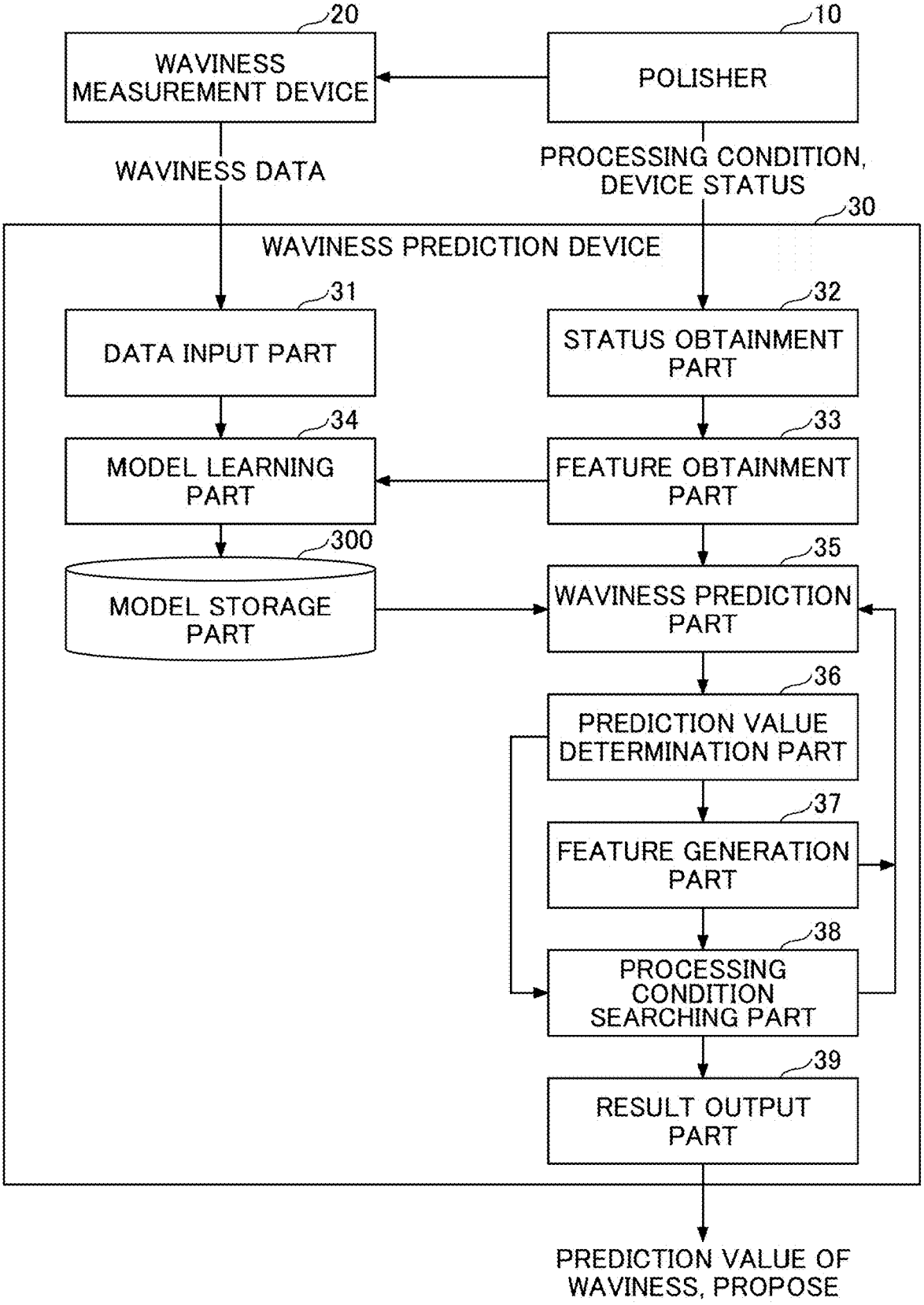
FIG. 4 is a view illustrating one example of a functional configuration of a waviness prediction system.

As illustrated in FIG. 4, the waviness prediction device 30 in the present embodiment includes a data input part 31, a status obtainment part 32, a feature obtainment part 33, a model learning part 34, a waviness prediction part 35, a prediction value determination part 36, a feature generation part 37, a processing condition searching part 38, a result output part 39, and a model storage part 300.

The processing parts included in the waviness prediction device 30 (excluding the model storage part 300) are realized through processes executed by the CPU 501. The CPU 501 is caused to execute the processes by the programs deployed from the HDD 504 on the RAM 503 as illustrated in FIG. 2. The model storage part 300 included in the waviness prediction device 30 is, for example, realized using the HDD 504 as illustrated in FIG. 2.

The data input part 31 receives an input of a measurement value of waviness (hereinafter also referred to as "waviness data") that is output by the waviness measurement device 20. As the input of the waviness data, the waviness data that is output to a display or the like by the waviness measurement device 20 may be input by a user using the input device 505, or the waviness data that is transmitted by the waviness measurement device 20 to the waviness prediction device 30 via the communication network N1 may be input online.

In response to the data input part 31 receiving the input of the waviness data, the status obtainment part 32 obtains status information on polishing from the polisher 10. The status information in the present embodiment includes a status of a polishing pad, a processing condition, and a device condition. The status of the polishing pad is, for example, the number of processed polishing targets that indicates the total number of polishing targets polished by that polishing pad. The processing condition is, for example, a polishing time per polishing treatment or a rotation speed of each surface plate. The device condition is, for example, a torque of each gear.

The feature obtainment part 33 obtains a predetermined feature from the status information obtained by the status obtainment part 32. The feature in the present embodiment includes the number of polishing targets processed by the polishing pad, and the torque of the sun gear (hereinafter also referred to as a "sun gear torque"). Also, the feature in the present embodiment may include a difference in the number of rotations between the upper surface plate and the lower surface plate.

The model learning part 34 generates a prediction model by learning a relationship between the feature obtained by the feature obtainment part 33 and the waviness data received by the data input part 31. The prediction model in the present embodiment is a model in which the number of processed polishing targets and the sun gear torque are an explanatory variable, and the waviness data is an objective variable. Also, when the feature includes the difference in the number of rotations, the prediction model in the present embodiment is a model in which the number of processed polishing targets, the sun gear torque, and the difference in the number of rotations are an explanatory variable, and the waviness data is an objective variable.

The model storage part 300 stores the prediction model generated by the model learning part 34.

The waviness prediction part 35 calculates the prediction value of the waviness by inputting the feature obtained by the feature obtainment part 33 to the prediction model stored in the model storage part 300. Also, the waviness prediction part 35 calculates the prediction value of the waviness by inputting the feature generated by the feature generation part 37 to the prediction model stored in the model storage part 300.

The prediction value determination part 36 determines whether or not the prediction value of the waviness is equal to or higher than a predetermined threshold by comparing the prediction value of the waviness calculated by the waviness prediction part 35 with the predetermined threshold.

The feature generation part 37 generates a predetermined feature based on the feature obtained by the feature obtainment part 33. The feature generated by the feature generation part 37 is a feature that is presumed to be obtained upon performing the next prediction of waviness.

The processing condition searching part 38 searches for a processing condition that the prediction value of the waviness becomes lower than the predetermined threshold, when the prediction value of the waviness is determined by the prediction value determination part 36 to be equal to or higher than the predetermined threshold.

The result output part 39 outputs prediction results of the waviness to the display device 506 or the like. The prediction results in the present embodiment include the prediction value of the waviness that is predicted by the waviness prediction part 35. Also, the prediction results in the present embodiment may include information indicating an operation to be performed.

<Processing Procedure of the Polishing System>

Next, a processing procedure of the waviness prediction method performed by the polishing system 1 in the present embodiment will be described with reference to FIG. 5 to FIG. 10. The waviness prediction method in the present embodiment includes a learning process of learning a prediction model (see FIG. 5) and a prediction process of predicting waviness using the trained prediction model (see FIG. 9 and FIG. 10).

<<Learning Process>>

Figure 5:
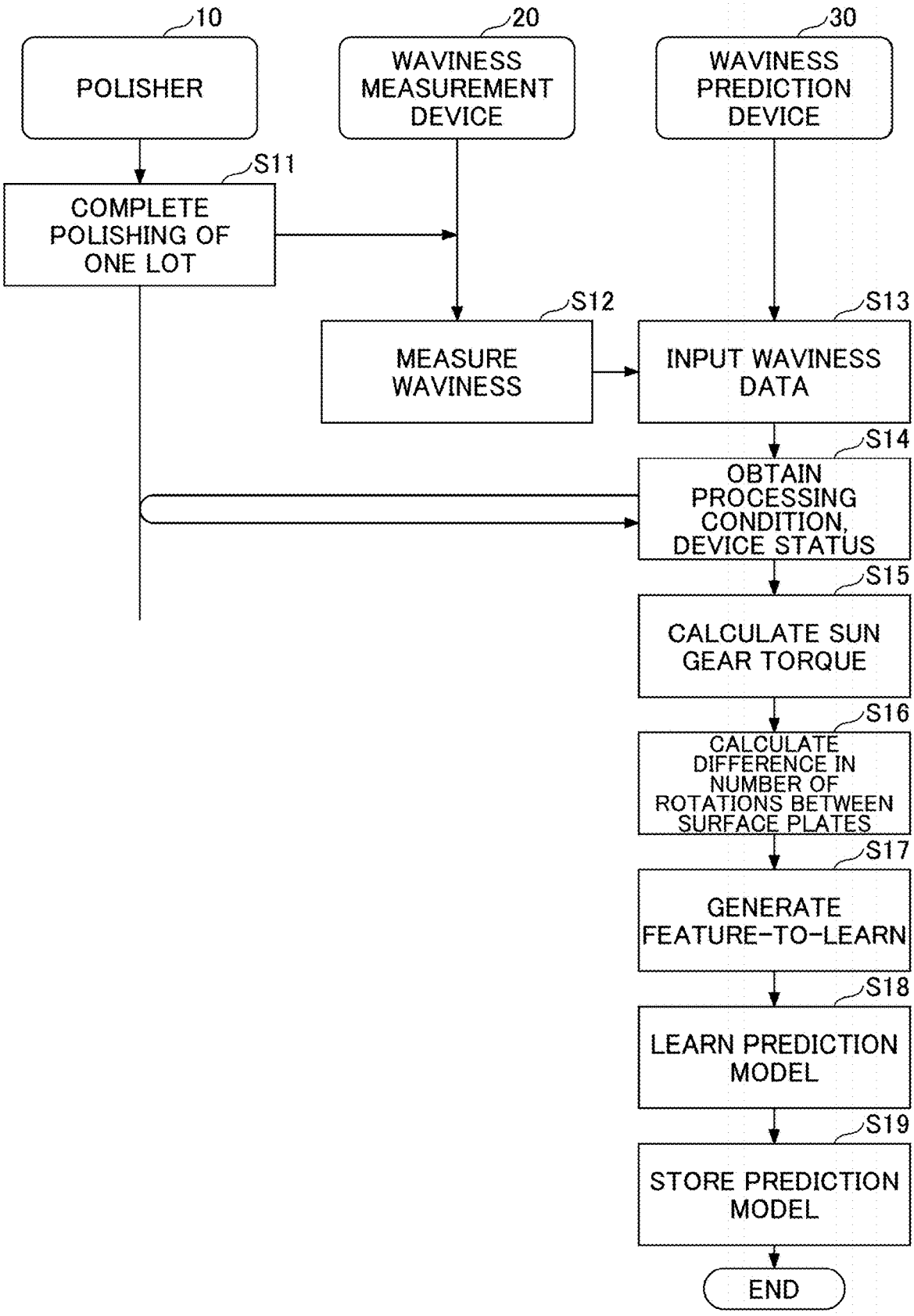
FIG. 5 is a flowchart illustrating one example of a procedure of a learning process.

FIG. 5 is a flowchart illustrating one example of a procedure of the learning process in the present embodiment.

In step S11, the polisher 10 completes polishing of one lot. Next, the polisher 10 outputs a notification indicating completion of the polishing of one lot.

In step S12, in response to the notification output by the polisher 10, the waviness measurement device 20 performs sampling of the polishing targets from the lot that completes the polishing, and measures the waviness of the polishing target surfaces. Next, the waviness measurement device 20 outputs the measured waviness data.

Figure 6:
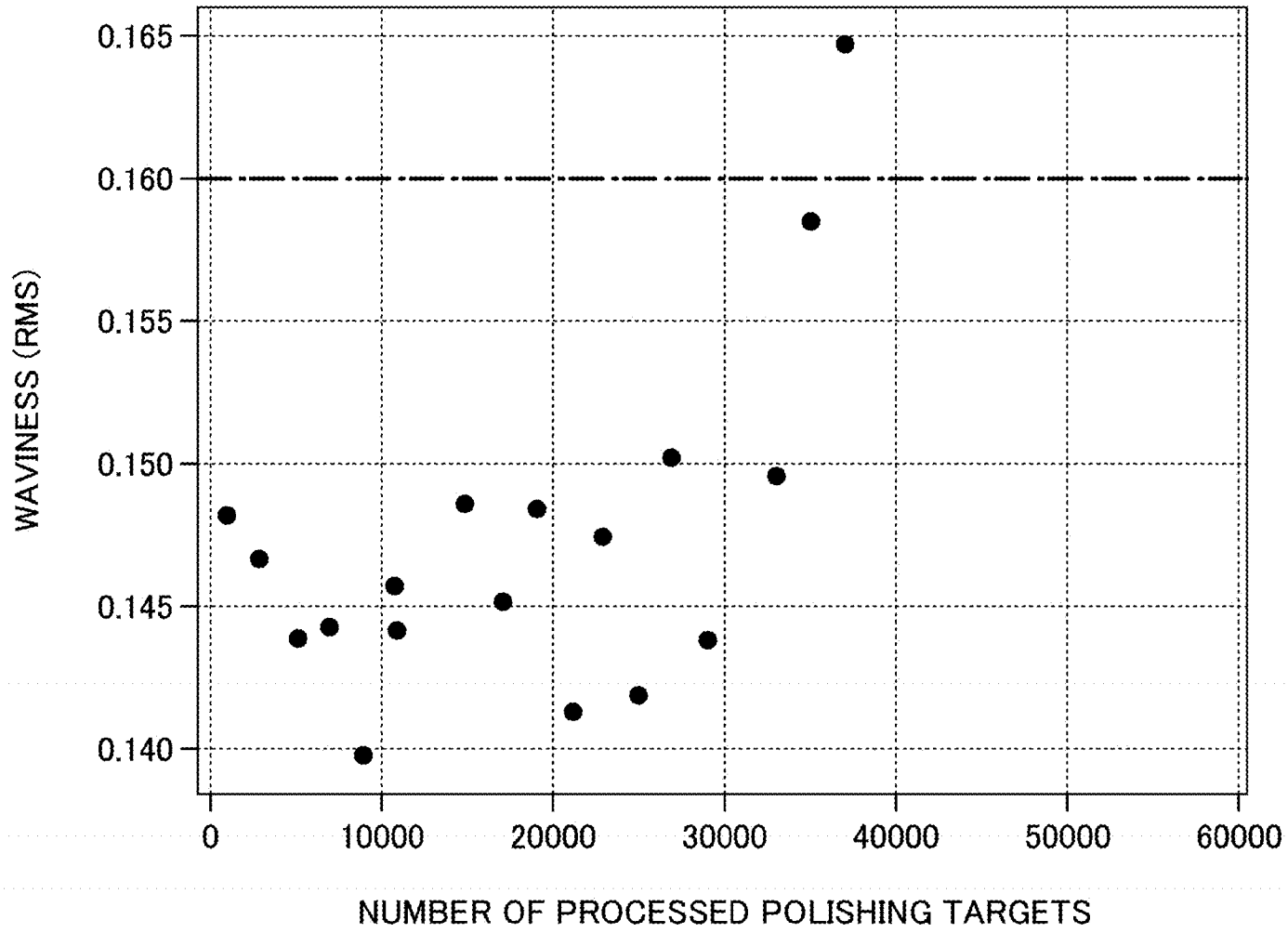
FIG. 6 is a graph illustrating one example of waviness data.

Here, the waviness data will be described with reference to FIG. 6. FIG. 6 is a graph illustrating one example of the waviness data. This graph plots the RMS measured per lot (=2,000 polishing targets) with the number of processed polishing targets being a horizontal axis and the waviness (RMS) being a vertical axis. Note that, the polishing targets to be measured for the waviness are sampled from the first batch of the lot. Also, because setting a new polishing pad is followed by initial polishing of dummies, the plotted number of the processed polishing targets is the total of exactly 2,000 processed polishing targets and the number of processed polishing targets subjected to dummy polishing.

The chain line (RMS=0.160) as illustrated in FIG. 6 represents a manufacturing standard. Exceeding this line is determined as occurrence of waviness abnormality. As illustrated in FIG. 6, the values of the RMS are greatly varied as a whole, but are found to rapidly increase once the number of processed polishing targets exceeds a certain number.

Referring back to FIG. 5, the description will be continued. In step S13, the data input part 31 included in the waviness prediction device 30 receives an input of the waviness data that is output by the waviness measurement device 20. Next, the data input part 31 transmits the received waviness data to the model learning part 34. Also, the data input part 31 notifies the status obtainment part 32 of receipt of the input of the waviness data.

In step S14, in response to the notification from the data input part 31, the status obtainment part 32 included in the waviness prediction device 30 obtains status information on polishing from the polisher 10, including the status of the polishing pad, the processing condition, and the device status. Next, the status obtainment part 32 transmits the obtained status information to the feature obtainment part 33.

In step S15, the feature obtainment part 33 included in the waviness prediction device 30 receives the status information from the status obtainment part 32. Next, the feature obtainment part 33 calculates the current sun gear torque based on the received status information.

Figure 7:
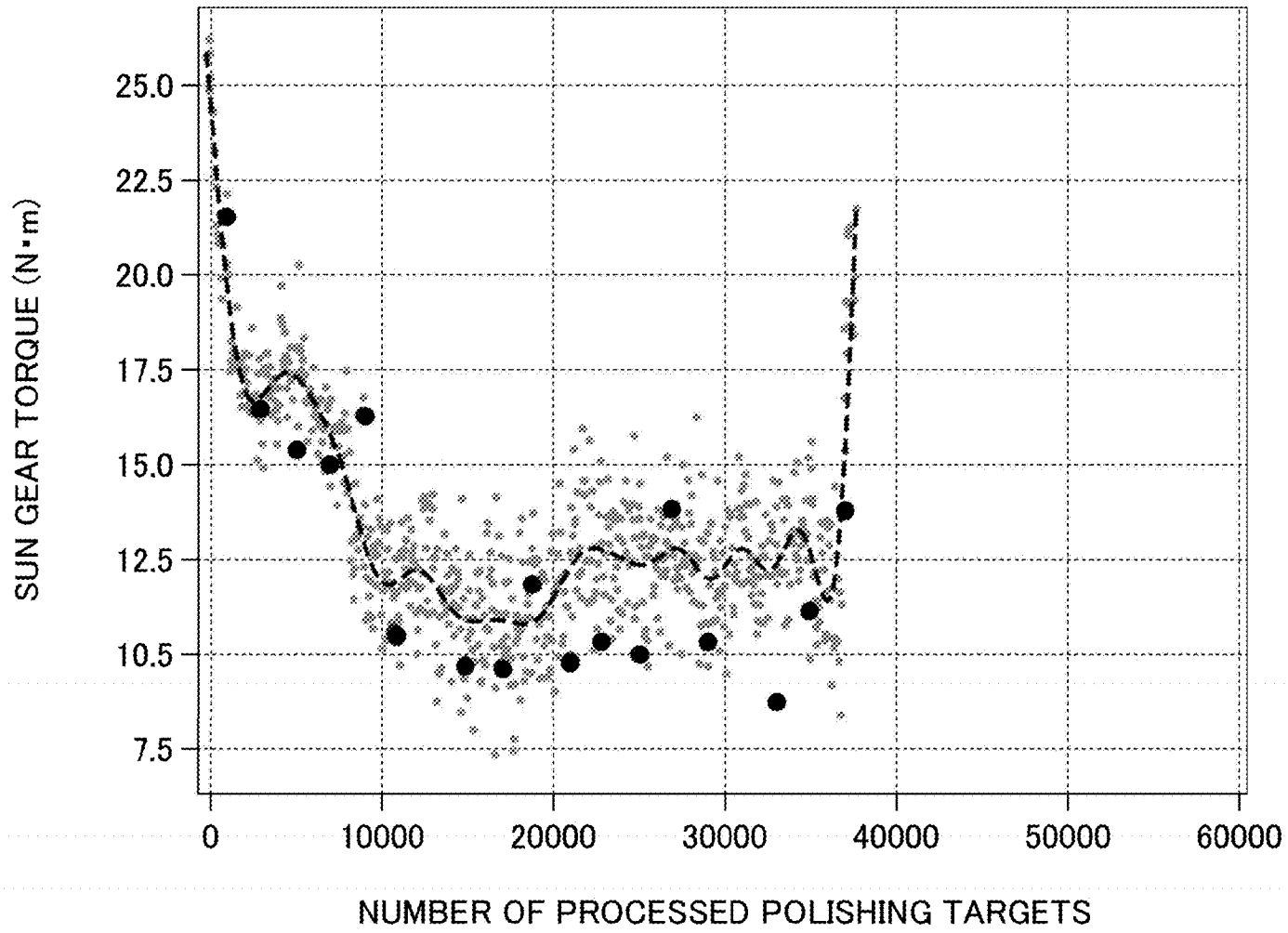
FIG. 7 is a graph illustrating one example of a sun gear torque.

Here, the sun gear torque will be described with reference to FIG. 7. FIG. 7 is a graph illustrating one example of the sun gear torque. This graph plots the sun gear torque obtained per batch (=50 polishing targets) with the number of processed polishing targets being a horizontal axis and the sun gear torque (N·m: newton meter) being a vertical axis. In FIG. 7, thick plots indicate the sun gear torque obtained in the batch measured for the waviness (i.e., the first batch of the lot) and thin plots indicate the sun gear torque obtained in the other batches.

As illustrated in FIG. 7, the values of the sun gear torque are greatly varied as a whole. Especially, because the measurement of the waviness is performed in the first batch, the waviness data tends not to reflect variation in the value of the torque. Therefore, in the present embodiment, the sun gear torque that is used is not the sun gear torque itself obtained from the polisher 10, but a value obtained through assignment to a trend line indicated with a dashed line. Note that, the trend line can be renewed per a predetermined number of batches. The trend line of the sun gear torque can be calculated, for example, through Gaussian process regression using RBF kernel. Note that, the regression applicable in the present embodiment is not limited to Gaussian process regression, and any regression may be used.

Referring back to FIG. 5, the description will be continued. In step S16, the feature obtainment part 33 calculates the current difference in the number of rotations based on the received status information. The difference in the number of rotations is a difference between the number of rotations of the lower surface plate 11 and the number of rotations of the upper surface plate 12.

Figure 8:
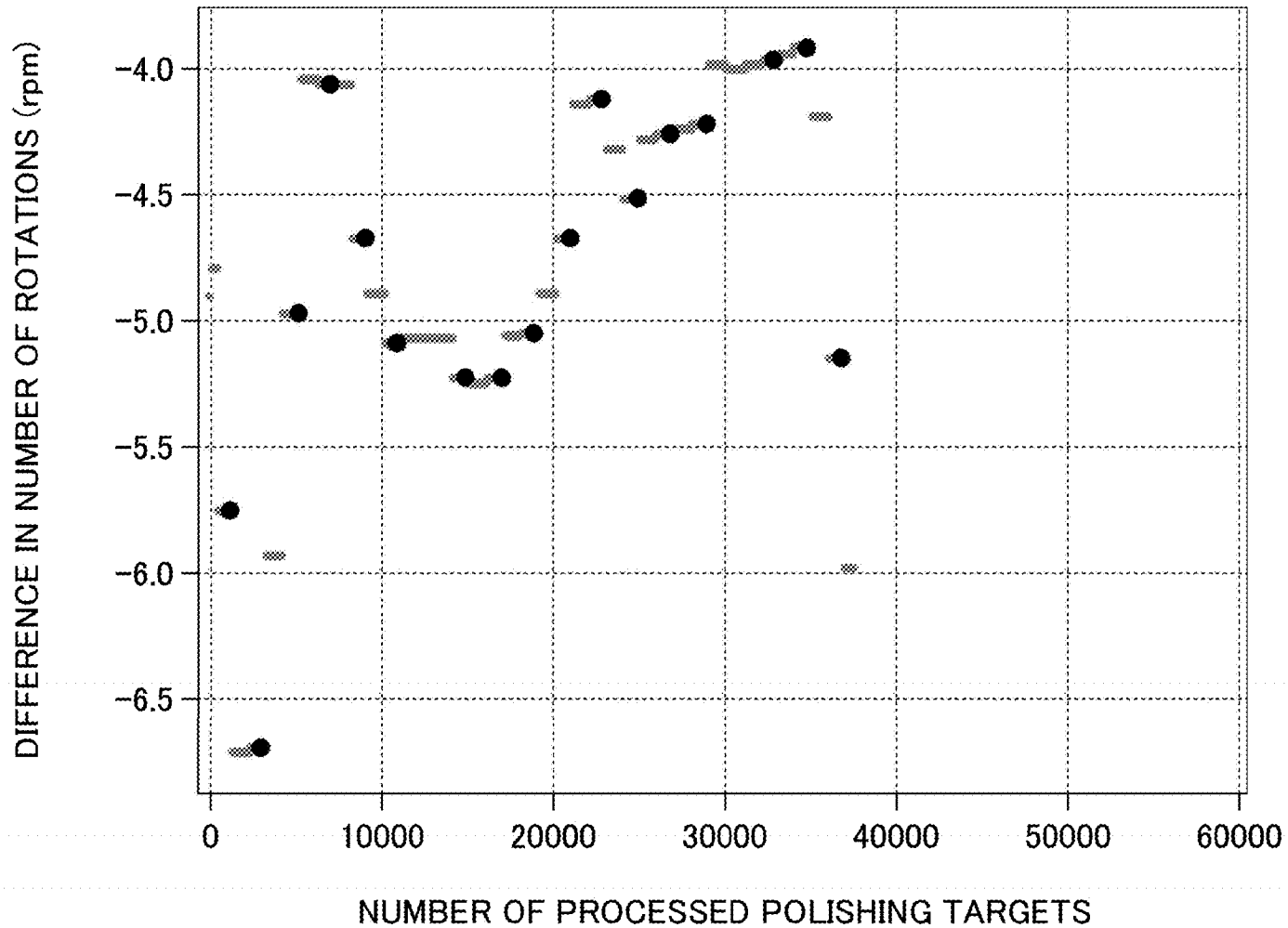
FIG. 8 is a graph illustrating one example of a difference in the number of rotations between surface plates.

Here, the difference in the number of rotations will be described with reference to FIG. 8. FIG. 8 is a graph illustrating one example of the difference in the number of rotations. This graph plots the difference in the number of rotations (=the number of rotations of the upper surface plate 12—the number of rotations of the lower surface plate 11) obtained per batch (=50 polishing targets) with the number of processed polishing targets being a horizontal axis and the difference in the number of rotations (rpm: rotations per minute) being a vertical axis. In FIG. 8, thick plots indicate the difference in the number of rotations measured in the batch measured for the waviness (i.e., the first batch of the lot) and thin plots indicate the difference in the number of rotations obtained in the other batches.

As illustrated in FIG. 8, the difference in the number of rotations is not greatly varied. This is because the number of rotations of each surface plate is controllable. Therefore, as the difference in the number of rotations in the present embodiment, the difference in the number of rotations between the surface plates obtained from the polisher 10 is used as is.

Referring back to FIG. 5, the description will be continued. In step S17, the feature obtainment part 33 generates a predetermined feature (hereinafter also referred to as a "feature-to-learn"). The feature-to-learn includes the number of processed polishing targets and the sun gear torque. Also, the feature-to-learn may include the difference in the number of rotations. Next, the feature obtainment part 33 transmits the generated feature-to-learn to the model learning part 34.

In step S18, the model learning part 34 included in the waviness prediction device 30 receives the waviness data from the data input part 31. Also, the model learning part 34 receives the feature-to-learn from the feature obtainment part 33. Next, the model learning part 34 generates a prediction model by learning a relationship between the feature-to-learn and the waviness data based on the waviness data and the feature-to-learn that are received. The prediction model can be calculated, for example, through Gaussian process regression using kernel that is a quadratic function. Note that, the regression applicable in the present embodiment is not limited to Gaussian process regression, and given regression is applicable as long as an output from the regression is probability.

In step S19, the model learning part 34 stores the trained prediction model in the model storage part 300.

<<Prediction Process>>

Figure 9:
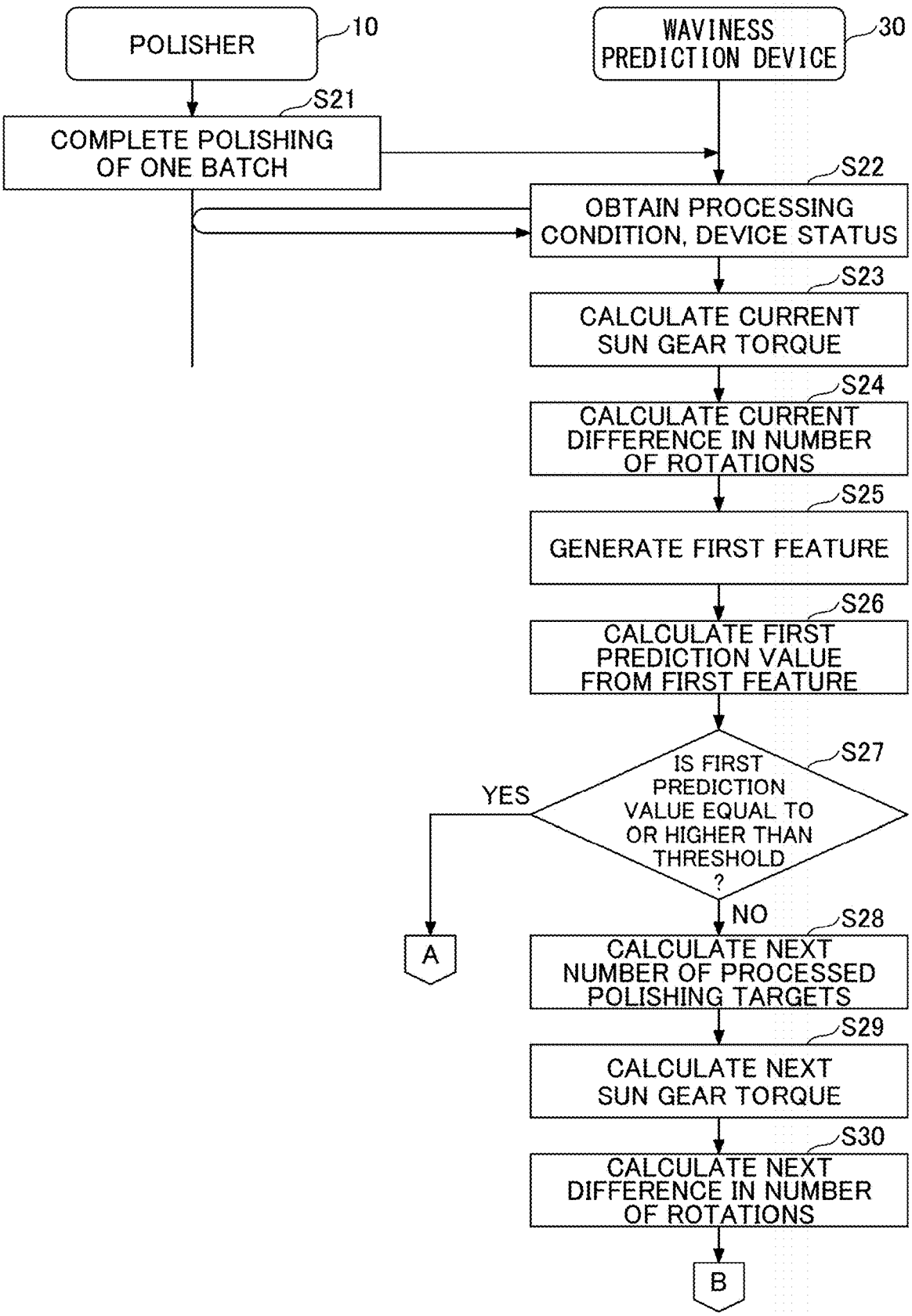
FIG. 9 is a flowchart illustrating one example of a procedure of a prediction process.
Figure 10:
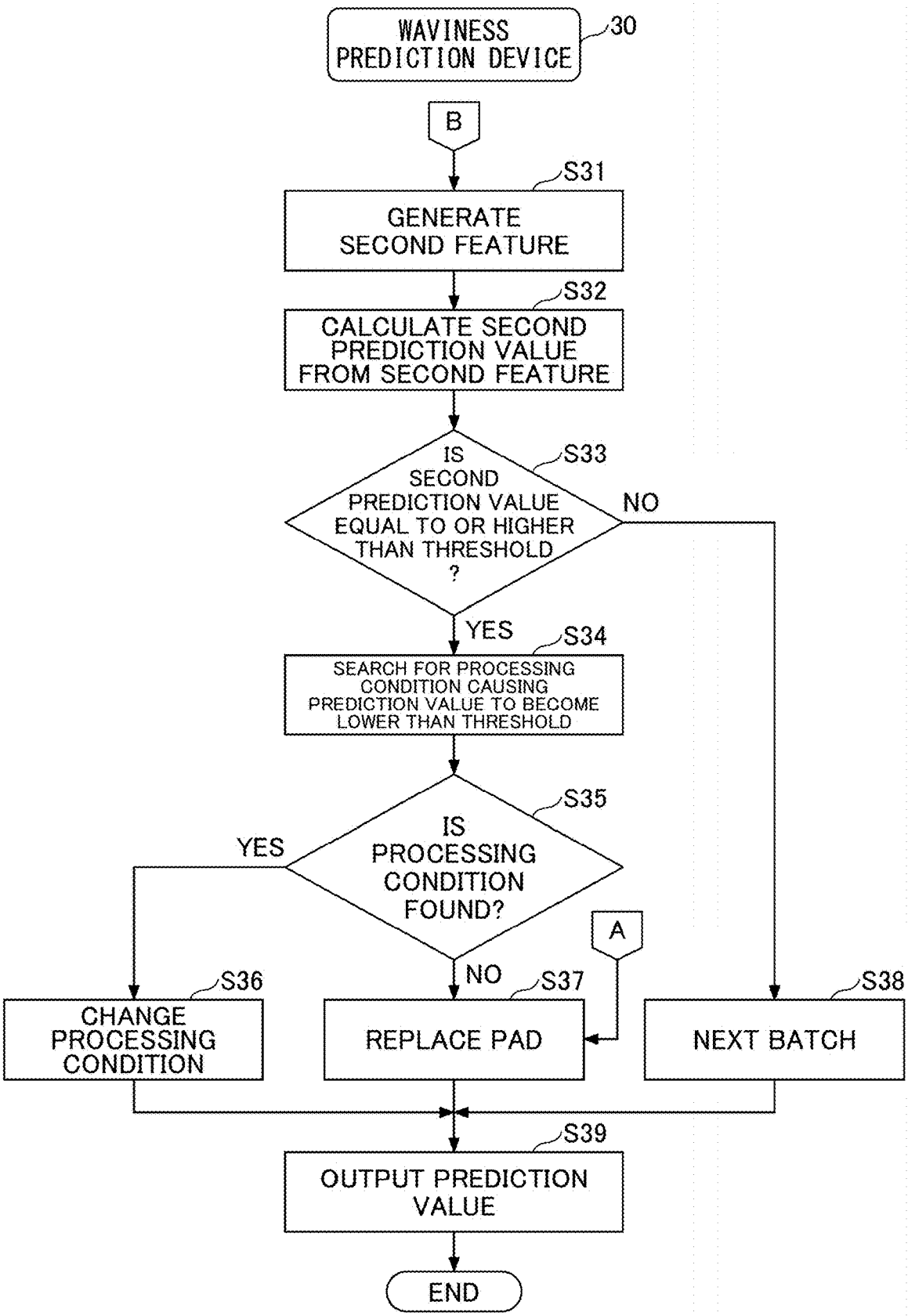
FIG. 10 is a flowchart illustrating one example of a procedure of a prediction process.

FIG. 9 and FIG. 10 are a flowchart illustrating one example of a procedure of the prediction process in the present embodiment.

In step S21, the polisher 10 completes polishing of one batch. Next, the polisher 10 outputs a notification indicating completion of the polishing of one batch.

In step S22, in response to the notification output by the polisher 10, the status obtainment part 32 included in the waviness prediction device 30 obtains status information on polishing from the polisher 10, including the status of the polishing pad, the processing condition, and the device status. Next, the status obtainment part 32 transmits the obtained status information to the feature obtainment part 33. Next, the status obtainment part 32 transmits the obtained status information to the feature obtainment part 33.

In step S23, the feature obtainment part 33 included in the waviness prediction device 30 receives the status information from the status obtainment part 32. Next, the feature obtainment part 33 calculates the current sun gear torque based on the received status information. Note that, the trend line of the sun gear torque can be renewed per a predetermined number of batches.

In step S24, the feature obtainment part 33 calculates the current difference in the number of rotations based on the received status information.

In step S25, the feature obtainment part 33 generates a predetermined feature (hereinafter also referred to as a "first feature"). Items included in the first feature are similar to the above-described items included in the feature-to-learn. Next, the feature obtainment part 33 transmits the generated first feature to the waviness prediction part 35 and the feature generation part 37.

In step S26, the waviness prediction part 35 included in the waviness prediction device 30 receives the first feature from the feature obtainment part 33. Next, the waviness prediction part 35 inputs the received first feature to the prediction model stored in the model storage part 300, thereby calculating a prediction value (hereinafter also referred to as a "first prediction value") of the waviness. Subsequently, the waviness prediction part 35 transmits the calculated first prediction value to the prediction value determination part 36 and the result output part 39.

In step S27, the prediction value determination part 36 included in the waviness prediction device 30 receives the first prediction value from the waviness prediction part 35. Next, the prediction value determination part 36 determines whether or not the first prediction value is equal to or higher than a predetermined threshold by comparing the first prediction value with the predetermined threshold.

When the prediction value determination part 36 determines that the first prediction value is equal to or higher than the predetermined threshold (YES), the process proceeds to step S37 as illustrated in FIG. 10. Meanwhile, when the prediction value determination part 36 determines that the first prediction value is lower than the predetermined threshold (NO), the process proceeds to step S28.

In step S28, the feature generation part 37 included in the waviness prediction device 30 receives the first feature from the feature obtainment part 33. Next, the feature generation part 37 calculates the second number of processed polishing targets based on the number of processed polishing targets included in the first feature. Specifically, the feature generation part 37 uses, as the second number of processed polishing targets, the sum of the number of processed polishing targets included in the first feature, and the number of polishing targets in one batch.

In step S29, the feature generation part 37 calculates a second sun gear torque based on the sun gear torque included in the first feature. Specifically, the feature generation part 37 calculates the second sun gear torque as a value obtained by assigning the second number of processed polishing targets to the trend line of the past sun gear torque.

In step S30, the feature generation part 37 calculates a second difference in the number of rotations based on the difference in the number of rotations included in the first feature. Specifically, the feature generation part 37 uses the difference in the number of rotations included in the first feature, as the second difference in the number of rotations. This is because the number of rotations of each surface plate does not change so often, and it is presumed that a similar value would be obtained upon the next prediction.

The description will be continued with reference to FIG. 10. In step S31, the feature generation part 37 generates a predetermined feature (hereinafter also referred to as a "second feature"). Items included in the second feature are similar to the above-described items included in the feature-to-learn. That is, when the feature-to-learn includes the number of processed polishing targets and the sun gear torque, the second feature includes the second number of processed polishing targets and the second sun gear torque. Also, when the feature-to-learn further includes the difference in the number of rotations, the second feature includes the second number of processed polishing targets, the second sun gear torque, and the second difference in the number of rotations. Next, the feature generation part 37 transmits the generated second feature to the waviness prediction part 35.

In step S32, the waviness prediction part 35 receives the second feature from the feature generation part 37. Next, the waviness prediction part 35 inputs the received second feature to the prediction model stored in the model storage part 300, thereby calculating a prediction value (hereinafter also referred to as a "second prediction value") of the waviness. Subsequently, the waviness prediction part 35 transmits the calculated second prediction value to the prediction value determination part 36 and the result output part 39.

In step S33, the prediction value determination part 36 receives the second prediction value from the waviness prediction part 35. Next, the prediction value determination part 36 determines whether or not the second prediction value is equal to or higher than a predetermined threshold by comparing the second prediction value with the predetermined threshold.

When the prediction value determination part 36 determines that the second prediction value is equal to or higher than the predetermined threshold (YES), the process proceeds to step S34. Meanwhile, when the prediction value determination part 36 determines that the second prediction value is lower than the predetermined threshold (NO), the process proceeds to step S38.

In step S34, the processing condition searching part 38 included in the waviness prediction device 30 searches for a processing condition that the prediction value of the waviness becomes lower than the predetermined threshold. Specifically, the processing condition searching part 38 repeats determination as to whether a prediction value is lower than the predetermined threshold, the prediction value being obtained by changing the second difference in the number of rotations included in the second prediction value by the predetermined number, and inputting the changed second feature to the prediction model. When the obtained prediction value is lower than the threshold or when the changed second difference in the number of rotations is outside the predetermined range, the processing condition searching part 38 ends the search.

Subsequently, the processing condition searching part 38 transmits the search results to the result output part 39. The search results include a found processing condition (i.e., the number of rotations of each surface plate that realizes the difference in the number of rotations that causes the prediction value to become lower than the predetermined threshold).

In step S35, the processing condition searching part 38 determines whether or not a processing condition that the prediction value becomes lower than the predetermined threshold is found. When the processing condition is found (YES), the processing condition searching part 38 causes the process to proceed to step S36. Meanwhile, when the processing condition is not found (NO), the processing condition searching part 38 causes the process to proceed to step S37.

In step S36, the result output part 39 included in the waviness prediction device 30 receives the search results from the processing condition searching part 38. Next, the result output part 39 outputs, on the display device 506 or the like, information indicating a need for change to the processing condition included in the search results.

In the polisher 10, the processing condition is changed in accordance with user's operations. That is, the number of rotations of the upper surface plate 12 and the lower surface plate 11 included in the polisher 10 is set to the number of rotations included in the found processing condition. The polisher 10 performs polishing of the polishing targets in accordance with the changed processing condition.

In step S37, the result output part 39 outputs, on the display device 506 or the like, information indicating a need for replacement of the polishing pad.

In step S38, the result output part 39 outputs, on the display device 506 or the like, information indicating performing polishing of the next batch.

In step S39, the result output part 39 receives the first prediction value and the second prediction value from the waviness prediction part 35. Next, the result output part 39 outputs, on the display device 506 or the like, information indicating the first prediction value and the second prediction value.

<Evaluation Results>

Subsequently, evaluation results of accuracy of the prediction value of the waviness in the present embodiment will be described with reference to FIG. 11 to FIG. 13. FIG. 11 is a table illustrating one example of evaluation indicators and evaluation results in the present embodiment.

(A) of FIG. 11 is a table illustrating one example of the evaluation indicators. In the evaluation, a batch in which the prediction value (probability) of the waviness is 50% or higher was defined as a batch in which the waviness abnormality is predicted (hereinafter also referred to as an "abnormality prediction batch") and a difference thereof from a batch in which the measurement value of the waviness actually exceeds the standard for manufacturing (hereinafter also referred to as an "abnormality occurrence batch") was obtained.

As illustrated in (A) of FIG. 11, when the number of processed polishing targets upon occurrence of the waviness abnormality was less than 30,000, the perfect score, 100 points, was scored when the abnormality prediction batch matched the abnormality occurrence batch, 60 points was scored when it was 1 or 2 lots before the abnormality occurrence batch, and 40 points was scored when it was 3 or more lots before the abnormality occurrence batch. Also, when the number of processed polishing targets upon occurrence of the waviness abnormality was 30,000 or more, the perfect score, 100 points, was scored when the abnormality prediction batch matched the abnormality occurrence batch, 80 points was scored when it was 1 or 2 lots before the abnormality occurrence batch, and 60 points was scored when it was 3 or more lots before the abnormality occurrence batch. The case in which the abnormality occurrence batch was followed by the abnormality prediction batch means missing waviness abnormality, which was scored as 0 points.

(B) of FIG. 11 is a table illustrating one example of the evaluation results. As illustrated in (B) of FIG. 11, three models with different features were provided, and prediction results by the models were calculated for scores in accordance with the evaluation indicators as illustrated in (A) of FIG. 11. Note that, the score is an average of the scores calculated for each of 26 polishing pads.

Model A is a model that learned the number of processed polishing targets alone as the explanatory variable and the feature. Model B is a model that learned the number of processed polishing targets and the sun gear torque as the explanatory variable and the feature. Model C is a model that learned the number of processed polishing targets, the sun gear torque, and the difference in the number of rotations as the explanatory variable and the feature.

As illustrated in (B) of FIG. 11, the score greatly increases in Model B, which learned the sun gear torque as the additional feature, compared to Model A, which learned the number of processed polishing targets alone as the feature. Also, the score further increases in Model C, which learned the difference in the number of rotations as the additional feature, compared to Model B. Therefore, it was indicated that compared to prediction using the number of processed polishing targets alone as the feature, the prediction accuracy was greatly increased by the addition of the sun gear torque to the feature. Also, it was indicated that the prediction accuracy was further increased by the addition of the difference in the number of rotations to the features.

Figure 12:
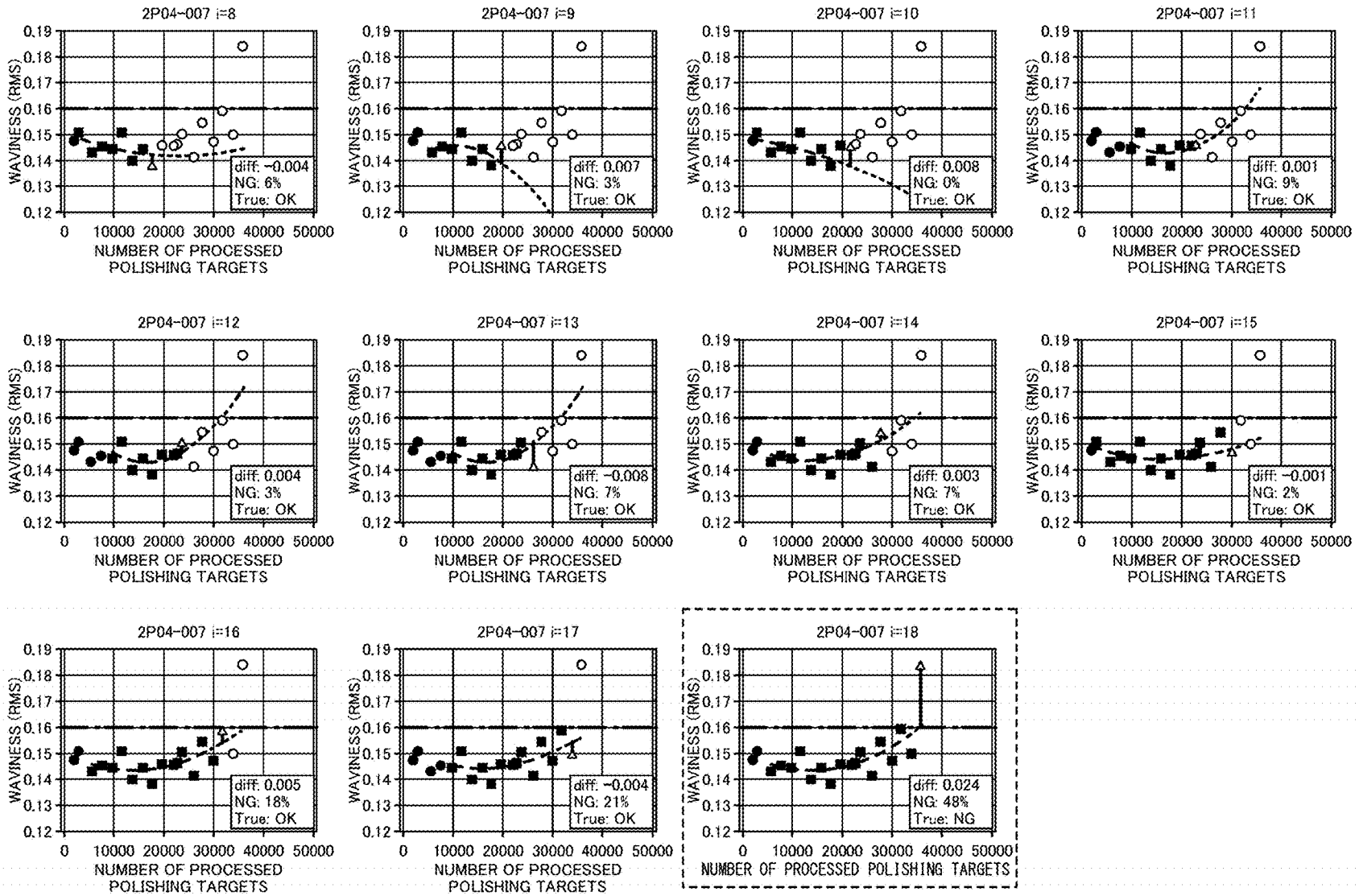
FIG. 12 illustrates graphs illustrating one example of evaluation results in related art.

FIG. 12 illustrates graphs of evaluations of measurement results (black circles, black squares, and blank circles) of the waviness obtained in a certain polishing pad by Model A, which learned the number of processed polishing targets alone as the explanatory variable and the feature. Each graph plots measurement values of the waviness per lot, with the number of processed polishing targets being a horizontal axis and the waviness being a vertical axis. The symbol "i" denotes an index of the lot. In the measurement data, the waviness abnormality is found to occur at i=18.

The graph indicates the results (dotted line) obtained by predicting the waviness of presumption values of the $i^{th}$ lot (the measurement value plotted with a blank triangle) using a model that performed learning using the measurement values of the $i-1^{th}$ lot and the previous lots (the measurement values plotted with black squares). The symbol "NG" on the lower-right portion of the graph is probability of the predicted waviness abnormality. When this value is 50% or higher, the waviness abnormality is determined.

As illustrated in FIG. 12, in the evaluation results obtained using Model A, the waviness abnormality is not detected at i=18 (NG: 48%), and miss of the waviness abnormality occurs. Therefore, in the example of FIG. 12, the score is 0 points.

Figure 13:
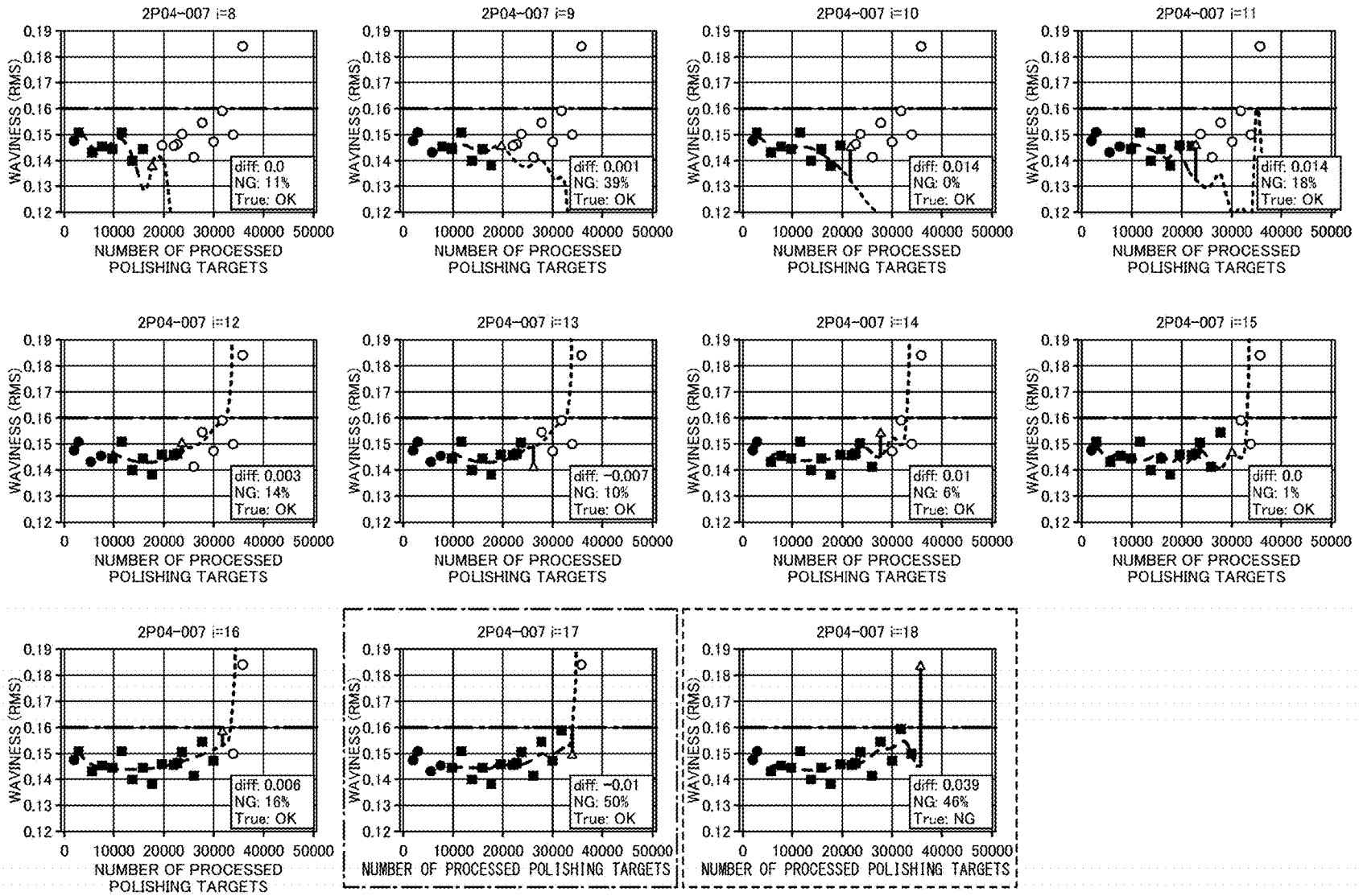
FIG. 13 illustrates graphs illustrating one example of evaluation results in one embodiment.

FIG. 13 illustrates graphs of evaluations of measurement results (black circles, black squares, and blank circles) of the waviness obtained in the same manner as in FIG. 12 by Model B, which learned the number of processed polishing targets and the sun gear torque as the explanatory variables and the features.

As illustrated in FIG. 13, in the evaluation results obtained using Model B, the waviness abnormality is detected at i=17 (NG: 50%). The waviness abnormality is detected one lot before, and this may be regarded as false detection. However, because the detection is made before occurrence of the waviness abnormality, it is possible to prevent products from being discarded. Therefore, in the example of FIG. 13, the score is 80 points.

Note that, in FIG. 12 and FIG. 13, the prediction of the waviness starts at i=8 and the subsequent lots. This is because the movements immediately after the start of polishing are not stable, and a small impact occurs from the viewpoint of the lifetime of the polishing pad even if the lots before that are excluded from lots to be detected for the waviness abnormality. What number of a batch to start prediction for (i.e., how much training data to collect before learning a prediction model) is a factor to be tuned as a hyperparameter. Here, an indicator of hyperparameter tuning was an absolute value of a prediction residual of validation data.

Effects of Embodiment

The polishing system in the present embodiment predicts waviness of a polishing target surface, without measuring the waviness, using a prediction model that learns a relationship between the waviness data and the feature based on the status information obtained from the polisher. Thereby, according to the polishing system in the present embodiment, it is possible to detect the waviness abnormality at an early stage. If the waviness abnormality can be detected at an early stage, it is possible to replace the polishing pad at an early stage, and reduce the number of the products that get discarded when the waviness abnormality occurs.

Also, the polishing system in the present embodiment can propose an operation to be performed in accordance with the prediction value of the waviness. Especially, when the waviness abnormality is predicted and a processing condition causing no waviness abnormality is found, it is possible to propose to make change to that processing condition. Thereby, the polishing system in the present embodiment enables long-term use of the polishing pad. Therefore, according to the polishing system in the present embodiment, it is possible to reduce cost for the polishing pad and inhibit reduction in operation rate due to replacement of the polishing pad.

[Supplement]

While embodiments of the present invention have been described above in detail, the present invention is not limited to these embodiments, and various modifications or alterations are possible within the scope of the gist of the present invention recited in claims.

The present application claims priority to Japanese Patent Application No. 2021-212624, filed with Japan Patent Office on Dec. 27, 2021, the contents of which are incorporated herein by reference in their entirety.

REFERENCE SIGNS LIST

1 polishing system
10 polisher
20 waviness measurement device
30 waviness prediction device
31 data input part
32 status obtainment part
33 feature obtainment part
34 model learning part
35 waviness prediction part
36 prediction value determination part
37 feature generation part
38 processing condition searching part
39 result output part
300 model storage part

The invention claimed is:

1. A waviness prediction device, comprising:
a processor; and
a memory storing one or more programs, which when executed, cause the processor to:
receive an input of waviness data obtained by measuring waviness of a polishing target surface that is polished by rotating a polishing pad with a planetary gear mechanism;
obtain a feature including both a number of processed polishing targets in the polishing pad, and a torque of a sun gear; and
predict the waviness by inputting the obtained feature to a prediction model that learns a relationship between the feature and the waviness data.

2. The waviness prediction device according to claim 1, wherein
the polishing target surface is polished by rotating, in opposite directions, an upper surface plate provided with a first polishing pad and a lower surface plate provided with a second polishing pad, and
the feature further includes a difference in number of rotations between the upper surface plate and the lower surface plate.

3. The waviness prediction device according to claim 2, wherein
the one or more programs, which when executed, cause the processor to:
generate a second feature including a second number of processed polishing targets that is larger than the number of processed polishing targets, and a second torque that is the torque of the sun gear upon processing the second number of processed polishing targets, and
predict the waviness by inputting the second feature to the prediction model.

4. The waviness prediction device according to claim 3, wherein
the one or more programs, which when executed, cause the processor to:
compare a prediction value of the waviness, with a predetermined threshold, and
search for a processing condition that the prediction value of the waviness becomes lower than the threshold, when the prediction value of the waviness is equal to or higher than the threshold.

5. The waviness prediction device according to claim 4, wherein
the one or more programs, which when executed, cause the processor to:
learn the prediction model using the waviness data received and the feature obtained, every time a predetermined number of the polishing target surface is polished by the polishing pad.

6. The waviness prediction device according to claim 3, wherein
the one or more programs, which when executed, cause the processor to:
learn the prediction model using the waviness data received and the feature obtained, every time a predetermined number of the polishing target surface is polished by the polishing pad.

7. The waviness prediction device according to claim 2, wherein
the one or more programs, which when executed, cause the processor to:
learn the prediction model using the waviness data received and the feature obtained, every time a predetermined number of the polishing target surface is polished by the polishing pad.

8. The waviness prediction device according to claim 1, wherein
the one or more programs, which when executed, cause the processor to:
learn the prediction model using the waviness data received and the feature obtained, every time a predetermined number of the polishing target surface is polished by the polishing pad.

9. The waviness prediction device according to claim 8, wherein
the program, which when executed, causes the processor to learn the prediction model is a program, which when executed, causes the processor to:
learn the prediction model for each of the polishing pads.

10. A waviness prediction method, comprising:
a) receiving an input of waviness data obtained by measuring waviness of a polishing target surface that is polished by rotating a polishing pad with a planetary gear mechanism;
b) obtaining a feature including both a number of processed polishing targets in the polishing pad, and a torque of a sun gear; and
c) predicting the waviness by inputting the obtained feature to a prediction model that learns a relationship between the feature and the waviness data,
a), b), and c) being performed by a computer.

11. A processing method for a polishing target, the processing method comprising:
a) receiving an input of waviness data obtained by measuring waviness of a polishing target surface that is polished by rotating a polishing pad with a planetary gear mechanism;

b) obtaining a feature including both a number of processed polishing targets in the polishing pad, and a torque of a sun gear;

c) predicting the waviness by inputting the obtained feature obtained in the feature obtainment procedure to a prediction model that learns a relationship between the feature and the waviness data;

d) comparing a prediction value of the waviness with a predetermined threshold;

e) searching for a processing condition that the prediction value of the waviness becomes lower than the threshold, when the prediction value of the waviness is equal to or higher than the threshold, a), b), c), d), and e) being executed by a computer; and f) processing the polishing target based on the processing condition that is found in e), f) being performed by a polisher.

12. A non-transitory computer-readable recording medium storing a program for causing a computer to execute:

receiving an input of waviness data obtained by measuring waviness of a polishing target surface that is polished by rotating a polishing pad with a planetary gear mechanism;

obtaining a feature including both a number of processed polishing targets in the polishing pad, and a torque of a sun gear; and predicting the waviness by inputting the obtained feature to a prediction model that learns a relationship between the feature and the waviness data.

* * * * *